US006121334A

United States Patent [19]

Winter

[11] Patent Number: 6,121,334

[45] **Date of Patent: *Sep. 19, 2000**

[54] GAS HANDLING FOR PLASTICS LIQUEFACTION

[75] Inventor: John D. Winter, Independence, Kans.

[73] Assignee: Texaco Inc., White Plains, N.Y.

[ * ] Notice: This patent is subject to a terminal disclaimer.

[21] Appl. No.: 09/230,133

[22] PCT Filed: Jul. 14, 1997

[86] PCT No.: PCT/US97/12481

§ 371 Date: May 13, 1999

§ 102(e) Date: May 13, 1999

[87] PCT Pub. No.: WO98/02504

PCT Pub. Date: Jan. 22, 1998

Related U.S. Application Data

[63] Continuation of application No. 08/887,978, Jul. 3, 1997, Pat. No. 5,837,037

[60] Provisional application No. 60/021,817, Jul. 16, 1996, abandoned, and provisional application No. 06/021,877, Jul. 17, 1996, abandoned.

[51] Int. Cl.[7] ..... C08J 11/10; C08J 11/14; B01D 53/14

[52] U.S. Cl. ..... 521/47; 521/40.5

[58] Field of Search ..... 521/45; 95/172, 95/173, 228; 528/480; 203/52, 53; 200/68

[56] References Cited

U.S. PATENT DOCUMENTS

| | | | |
|---|---|---|---|
| 4,072,604 | 2/1978 | Ward | 208/341 |
| 4,401,561 | 8/1983 | Thompson et al. | 208/212 |
| 4,810,267 | 3/1989 | Landeck | 55/73 |
| 5,837,037 | 11/1998 | Winter | 95/172 |

FOREIGN PATENT DOCUMENTS

| | | |
|---|---|---|
| 08334221 | 6/1995 | Japan . |
| 09263774 | 9/1997 | Japan . |
| 0929128 | 11/1997 | Japan . |

*Primary Examiner*—Vasu Jagannathan
*Assistant Examiner*—Katarzyna Wyrozebski
*Attorney, Agent, or Firm*—Harold J. Delhommer; Rodman & Rodman

[57] ABSTRACT

The present invention relates to a method for removing high molecular weight high melting point hydrocarbon vapors from a hydrocarbon vapor offgas stream produced during the liquefaction of a solid waste plastic material to produce an oil that serves as a liquid feedstock for a partial oxidation reaction. The hydrocarbon vapor offgas stream (2) is directly contacted with a water spray (4) at a condensation temperature above the melting point of the high molecular weight hydrocarbons contained in the offgas. This results in the condensation and convenient removal of the high melting point hydrocarbons, referred to as "waxes." One or more subsequent condensation steps can be conducted at lower condensation temperatures to remove the lower temperature condensable hydrocarbons. The remaining uncondensed vapors are then recycled to serve as a heater fuel for the liquefaction of the waste plastic material.

8 Claims, 1 Drawing Sheet

GAS HANDLING FOR PLASTICS LIQUEFACTION

This application is a §371 filing of PCT/US97/12481 filed Jul. 14, 1997 which is a continuation of U.S. application Ser. No. 08/887,978 filed Jul. 3, 1997, now U.S. Pat. No. 5,837,037 which issued Nov. 17, 1998, and also claims the benefit of U.S. Provisional Application Ser. Nos. 60/021,817 filed Jul. 16, 1996, now abandoned and 60/021,877 filed Jul. 17, 1996, now abandoned.

BACKGROUND OF THE INVENTION

1. Field of the Invention

This invention relates to a method for removing high molecular weight low melting point hydrocarbon vapors from an offgas stream produced during liquefaction of a waste plastic material, and more particularly for utilizing the offgas vapor stream as a heater fuel for the liquefaction process.

2. Description of the Prior Art

Diminishing natural resources as well as economic considerations have led to the increasing use of organic feedstocks from impure sources, such as scrap or waste plastic materials.

Waste or scrap plastic materials often comprise at least one solid carbonaceous thermoplastic and/or thermosetting material which may or may not contain associated inorganic matter, such as fillers and reinforcement material. Such materials may be derived from obsolete equipment, household containers, packaging, industrial sources, recycling centers and discarded automobiles. Scrap plastic comprises solid organic polymers derived from sheets, films, extruded shapes, moldings, reinforced plastics, laminates and foamed plastics. The mixture of scrap plastics varies with the source and with the presence of non-combustible inorganic matter incorporated in the plastic as fillers, catalysts, pigments and reinforcing agents.

It is desirable to convert particulate scrap plastic into a liquid hydrocarbonaceous feedstock for a partial oxidation reaction to produce gas mixtures of hydrogen and carbon monoxide, referred to as synthesis gas, or simply "syngas." Syngas can be used to make other useful organic compounds or as a fuel to produce power.

The partial oxidation reaction can be conducted in a free-flow unpacked noncatalytic quench gasifier. The reaction temperature varies about 1800° F. to about 3000° F. and the reaction pressure is about 1 to about 100 atmospheres, preferably about 30 to about 80 atmospheres.

SUMMARY OF THE INVENTION

The present invention relates to a method for removing high molecular weight high melting point hydrocarbon vapors from a hydrocarbon vapor offgas stream produced during the liquefaction of a solid waste plastic material to produce an oil that serves as a liquid feedstock for a partial oxidation reaction. The hydrocarbon vapor offgas stream is directly contacted with a water spray at a condensation temperature above the melting point of the high molecular weight hydrocarbons contained in the offgas. This results in the condensation and convenient removal of the high melting point hydrocarbons, referred to as "waxes." One or more subsequent condensation steps can be conducted at lower condensation temperatures to remove the lower temperature condensible hydrocarbons. The remaining uncondensed vapors are then recycled to serve as a heater fuel for the liquefaction of the waste plastic material.

BRIEF DESCRIPTION OF THE DRAWING

The accompanying drawing is a simplified diagrammatic representation of the offgas condensation operation.

DESCRIPTION OF THE PREFERRED EMBODIMENTS

Figure 1:
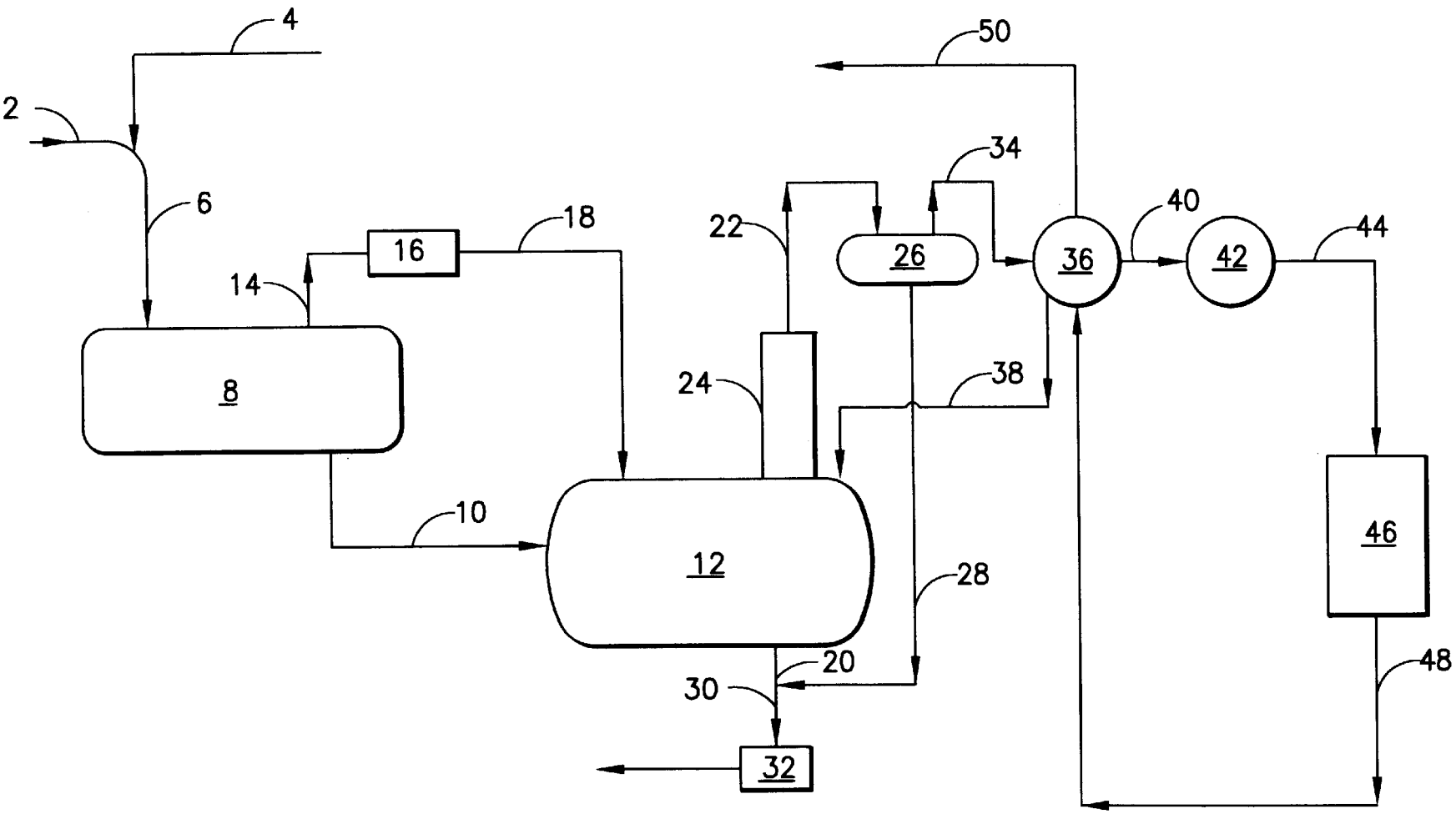

Particulate waste plastic materials, even those containing halogens can be converted by thermal cracking to an oil composition suitable as a feedstock for a partial oxidation reaction in a quench gasifier to produce a synthesis gas.

The liquefaction of the particulate waste plastic materials, particularly bulk waste plastic materials involves melting the waste plastic material by direct contact with a hot oil melting medium to produce a molten viscous mixture of the waste plastic materials in the hot oil melting medium. The melting of the waste plastic material also produces an offgas vapor which includes hydrocarbon vapors of varying molecular weights, carbon dioxide and water vapor. Depending upon the nature of the waste plastic material, acid halides and halohydrocarbons can also be contained in the offgas vapor.

An important aspect of this invention is the treatment of the offgases generated during the liquefaction of the particulate waste plastic material to recover condensible hydrocarbons and to use uncondensed hydrocarbon vapors to fuel the heater used in the liquefaction of the particulate scrap plastic materials.

Offgas vapors contain a mixture of condensible hydrocarbons of varying molecular weight, including high molecular weight hydrocarbons referred to as "waxes", which condense at temperatures on the order of about 210° F. to about 280° F. The offgas vapors also include lower molecular weight condensible hydrocarbons which condense at a temperature of about 200° F., below which temperature the hydrocarbon waxes solidify.

Therefore, by exposing the hydrocarbon containing offgas from the liquefaction of waste plastics to a temperature below the melting point of the hydrocarbon waxes can result in a mixture of condensed liquid hydrocarbons and solidified and/or highly viscous hydrocarbon waxes. The solidified waxes can cause serious plugging and fouling in the condenser, as well as blockage problems in the gasification system pipelines and equipment.

It has been found that the initial condensation and separation of the high molecular weight hydrocarbon waxes from the offgas vapors at a condensation temperature above the melting point of the waxes, avoids the problem of blockage and plugging in the gasification system pipelines and equipment.

After the condensible waxes have been condensed and removed from the offgas, the offgas temperature can then be further reduced to condense and remove lower molecular weight condensible hydrocarbons in as many subsequent cooling and condensation steps that are needed, depending upon the composition of the offgas. The offgas treatment includes the removal of water and any acid halide vapors, particularly hydrogen chloride (HCl) from the offgas.

Thus, the invention includes the removal of condensible hydrocarbons in stages, depending upon the melting point of the hydrocarbons, so that high molecular weight "waxes" are removed from the offgas vapor prior to subsequent hydrocarbon condensation at lower temperatures to remove lower melting point condensible hydrocarbon vapors.

The invention can be more readily understood by referring to the FIGURE wherein an offgas hydrocarbon vapor stream 2 is the byproduct of the melting of particulate waste plastic materials in a hot oil liquefaction system to produce a molten viscous oil mixture and the offgas stream 2, which is directly contacted with water spray 4 to cool the offgas stream 2 to a temperature of about 210° F. to 280° F.

The spray cooling of offgas stream 2 condenses high melting point, high molecular weight hydrocarbon waxes at a temperature above the melting point of the waxes, thereby liquefying but not crystallizing or solidifying the waxes. Another purpose for the water spray, which can be in the form of an aqueous mist, is to attenuate the temperature fluctuations of the offgas to produce a mixture of water, uncondensed hydrocarbon vapors and condensed hydrocarbon wax stream 6 which enters condensate receiver 8, maintained at a temperature of about 210° F. to 280° F.

The water spray 4 is preferably supplied from an ammonia rich water stream exiting from an ammonia stripper (not shown) that is employed to treat scrubbing water that has been used as a scrubbing medium for synthesis gas exiting a quench gasifier (not shown).

The condensed hydrocarbon waxes are separated from the remaining uncondensed offgas vapor and exit the condensate receiver 8 in stream 10 and enter a second condensate receiver 12 that is maintained at a temperature of about 60° F. to about 140° F. The first condensate receiver 8 can be physically located above the second condensate receiver 12 so that the condensed liquid hydrocarbon wax stream 10 can flow by gravity from the receiver 8 to the receiver 12.

Uncondensed vapor stream 14, freed of the high molecular weight hydrocarbon waxes exits the condensate receiver 8 at a temperature of about 80° F. to about 140° F., and contains a mixture of hydrocarbons, water, carbon dioxide, and acid halides. As vapor stream 14 passes through the heat exchanger 16, additional hydrocarbon vapors condense to form a mixture with the remaining uncondensed vapors and exit as stream 18 which then enters the second condensate receiver 12 that is maintained at a temperature of about 60° F. to about 140° F. In the receiver 12, substantially wax-free hydrocarbons, and most polar species such as water, hydrogen halides, alcohols, glycols, aldehydes, organic acids, esters, and the like from stream 18 are separated from the remaining uncondensed hydrocarbon vapor and are combined with the higher molecular weight condensate wax stream 10, to form a combined condensate which exits condensate receiver 12 as stream 20.

An uncondensed vapor stream 22 is separated from stream 18 and exits condensate receiver 12 by passing through a scrubbing tower 24 which can be mounted directly on top of the condensate receiver 12. A caustic or ammonium hydroxide scrubbing solution can be supplied to the scrubber 24 to contact the vapor stream 22 and remove any traces of acid halides such as hydrogen chloride and to react with any chloromethane that may also be present in vapor 22 to form methanol which is returned to receiver 12. Excess scrubbing solution from scrubber 24 can also flow back directly into condensate receiver 12.

The uncondensed vapor stream 22 exiting the scrubber 24 is cooled in an indirect heat exchanger 26 to a temperature of about 40° F. to about 80° F. Additional more volatile substances condense from vapor stream 22 to form condensate stream 28 comprising principally organic compounds containing 4 to 10 carbon atoms and water which exits the heat exchanger 26 to combine with the condensed stream 20 that exits condensate receiver 12 to form combined stream 30 which enters pump 32 which periodically discharges the condensate to storage or for use as a chemical feedstock or as part of the feed to a gasification process. The cooled uncondensed hydrocarbon vapor stream 34 exits heat exchanger 26 and enters heat exchanger 36 where it is further cooled to a temperature of about 10° F. to about 50° F., and wherein stream 38 condenses and comprises principally hydrocarbon and halohydrocarbons containing 2–5 carbon atoms, and enters the condensate receiver 12. Optionally, all or a portion of stream 38 can be combined with stream 30 and discharged through pump 32 as noted above.

The remaining cooled uncondensed hydrocarbon vapor stream 40 exits heat exchanger 36 at a temperature of about 10° F. to about 50° F., enters heat exchanger 42 and exits as cooled hydrocarbon vapor stream 44 at a temperature of about −40° F. to about 10° F. Vapor stream 44 optionally enters the absorber 46 to remove any remaining traces of organic halides, and exits as hydrocarbon vapor stream 48 which is then recycled through the heat exchanger 36 as the cooling medium, and exits as warmed hydrocarbon vapor stream 50 at a temperature of about 20° F. to 60° F., to serve as a fuel for the liquefaction heater which melts the particulate waste plastic materials during the waste plastic liquefaction operation (not shown).

What is claimed is:

1. A method for removing high molecular weight, high melting point hydrocarbon vapors by condensation from a hydrocarbon-containing offgas vapor produced during the liquefaction of particulate waste plastic material, comprising:

(a) contacting the hydrocarbon-containig offgas vapor directly with water at a condensation temperature above the melting point of the high molecular weight hydrocarbon vapors to produce a first high molecular weight liquid hydrocarbon condensate and a first uncondensed vapor stream;

(b) separating the first high molecular weight liquid hydrocarbon condensate from the first uncondensed vapor stream;

(c) cooling the first uncondensed vapor stream to a temperature of about 180° F. to about 200° F. to produce a second liquid condensate and a second uncondensed vapor stream;

(d) separating the second liquid condensate from the second uncondensed vapor stream; and (e) contacting the second uncondensed vapor stream with a caustic scrubbing solution to neutralize any halide vapors and to form a hydrogen halide acid-free vapor stream.

2. The method of claim 1, wherein the first hydrocarbon condensate and the second hydrocarbon condensate are combined to form a single hydrocarbon condensate.

3. The method of claim 1 (a), wherein the water used to contact the hydrocarbon containing offgas vapor stream is in the form of a spray.

4. The method of claim 3, wherein the water contains ammonia or caustic.

5. The method of claim 3, wherein the water is supplied from an ammonia rich water stream exiting an ammonia stripper.

6. The method of claim 5, wherein the ammonia stripper is used to treat synthesis gas scrubbing water.

7. The method of claim 1 (a) wherein the water is at a temperature of about 210° F. to about 280° F.

8. A method for preventing blockage and plugging of piping and equipment by hydrocarbon waxes that are condensed from a hydrocarbon containing offgas from the liquefaction of waste plastic materials, comprising:

(a) contacting the hydrocarbon-containing offgas vapor directly with water at a condensation temperature above the melting point of the high molecular weight hydrocarbon vapors to produce a first high molecular weight liquid hydrocarbon condensate and a first uncondensed hydrocarbon vapor stream; and (b) separating the first high molecular weight liquid hydrocarbon condensate from the first uncondensed hydrocarbon vapor stream.

* * * * *